US006712354B1

(12) United States Patent
Semanick

(10) Patent No.: US 6,712,354 B1
(45) Date of Patent: Mar. 30, 2004

(54) ACCUMULATOR APPARATUS AND METHOD HAVING IMPROVED SHEET REGISTRATION

(75) Inventor: John J. Semanick, Bethlehem, PA (US)

(73) Assignee: Bell & Howell Mail and Messaging Technologies Company, Durham, NC (US)

( * ) Notice: Subject to any disclaimer, the term of this patent is extended or adjusted under 35 U.S.C. 154(b) by 97 days.

(21) Appl. No.: 09/810,791

(22) Filed: Mar. 16, 2001

(51) Int. Cl.[7] ..... B65H 31/00
(52) U.S. Cl. ..... 271/207
(58) Field of Search ..... 271/198, 207, 271/213, 202, 242, 272, 245; 414/789.9, 790.7, 790.8, 794.4

(56) References Cited

U.S. PATENT DOCUMENTS

| | | | | |
|---|---|---|---|---|
| 4,799,663 A | * | 1/1989 | Golicz | 271/199 |
| 5,178,379 A | * | 1/1993 | Edwards et al. | 271/189 |
| 5,244,200 A | | 9/1993 | Manzke | |
| 5,433,431 A | * | 7/1995 | Lowell | 271/198 |
| 5,775,689 A | | 7/1998 | Moser et al. | |

* cited by examiner

*Primary Examiner*—Donald P. Walsh
*Assistant Examiner*—Kenneth W Bower
(74) *Attorney, Agent, or Firm*—McDermott, Will & Emery

(57) ABSTRACT

An accumulator apparatus and method are provided for accumulating sheet articles. The accumulator apparatus includes an upper belt system and lower belt system operative for advancing sheet articles in seriatim manner therebetween. Guide rollers are provided at the entrance of the sheet articles between the upper and lower belt systems for guiding the sheet articles therebetween without pinching. Nip rollers are provided downstream from the entry guide rollers for pulling sheet articles into the accumulator apparatus between the guide rollers and the nip rollers. A ramp system operative for deflecting advancing sheet articles is provided downstream from the nip rollers. Sheet articles deflected by the ramp assembly can then be accumulated in an accumulation location where the lower belt system is maintained in a spaced-apart position below the accumulation location such that the lower belt system cannot contact or mark sheet articles accumulated therein. Stop rollers are provided for selectively stopping further advancement of accumulated sheet articles from the accumulation location and for pulling the accumulated sheet articles from the accumulation location to advance the sheet articles from the accumulator apparatus. A biasing element is provided and is affixed to the downstream end of the ramp. The function of the biasing element is to urge all accumulating sheet articles from behind towards and into the nip formed by the upper and lower stop rollers. The biasing element is provided to reduce or eliminate sheet misregistration or shingling back.

12 Claims, 6 Drawing Sheets

ACCUMULATOR APPARATUS AND METHOD HAVING IMPROVED SHEET REGISTRATION

TECHNICAL FIELD

The present invention relates generally to accumulator apparatuses and methods for accumulating sheet articles. More particularly, the present invention relates to an improved non-marking accumulator apparatus and method for reducing or eliminating mis-registration of sheet articles processed therethrough so that accumulated sheets are fed properly.

RELATED ART

Various accumulator apparatuses and methods have been employed in the past for accumulating sheet material or articles such as paper sheets, documents, and the like into stacks for subsequent advancement. Such accumulator apparatuses and methods have particular use in high-speed mail processing where preparation and processing of mailable articles often requires a plurality of sheet articles to be assembled into a packet for further handling which can include, for example, folding, inserting, collating, etc.

As just one example of such an accumulator apparatus, U.S. Pat. No. 5,244,200 to Manzke, commonly assigned herewith, discloses a retractable-ramp accumulator and method comprising driven endless elastic belts that feed sheets therebetween along a sheet-feeding path. A series of operatively connected and selectively retractable ramps are utilized for selectively deflecting sheets out of the sheet-feeding path for accumulating the sheets in a stack after they pass the ramps in a stacking location between the ramps and selectively releasable stop gates.

Another example of an accumulator apparatus and method is found is U.S. Pat. No. 5,775,689 to Moser et al, commonly assigned herewith.

As illustrated in the two exemplary patents identified above, it is common for prior art accumulators and methods to employ endless upper belts and lower belts for seriatim feeding of sheet articles therebetween. Both of these patents outline the basic operational, structural, and control features common to this type of machinery and well known to those skilled in the art.

A problem that exists with such prior art accumulator apparatuses and methods, however, is shown in somewhat exaggerated fashion in FIG. 1 herein. When more than two sheets S are stacked in the accumulator and the accumulator drive begins to feed the paper out of the accumulator in feed direction F, some sheets may and typically tend to shingle back and trail the accumulated set. This results in the accumulated set of sheets not being registered or "squared" as shown in FIGS. 3A and 3B. When the mis-registered set is sent to downstream machinery for further processing, this could result in, for example, bad folds and, even worse, machine jamming, machine stopping, and damaged paper.

In light of the prior art accumulator apparatuses and methods as described above and their deficiencies, there remains much room for improvement in the art for an accumulator apparatus and method which reduces or eliminates mis-registration of sheet articles processed therethrough so that the accumulated sheets are fed properly and are properly "squared" as shown in FIGS. 2A and 2B.

SUMMARY OF THE INVENTION

It is an object of the present invention to provide an accumulator apparatus that reduces mis-registration of sheet articles processed therethrough.

It is another object of the present invention to provide an accumulator apparatus that by reducing mis-registration of sheet articles processed therethrough, also reduces bad folds, machine jamming, machine stopping, and damaged paper.

It is a further object of the present invention to provide an accumulator method that reduces mis-registration of sheet articles as it is carried out.

It is a still further object of the present invention to provide an accumulator method that by reducing mis-registration of sheet articles as it is carried out, also reduces bad folds, machine jamming, machine stopping, and damaged paper.

Some of the objects of the invention having been stated, other objects will become evident as the description proceeds, when taken in connection with the accompanying drawings described below.

DETAILED DESCRIPTION OF THE INVENTION

Figure 1:
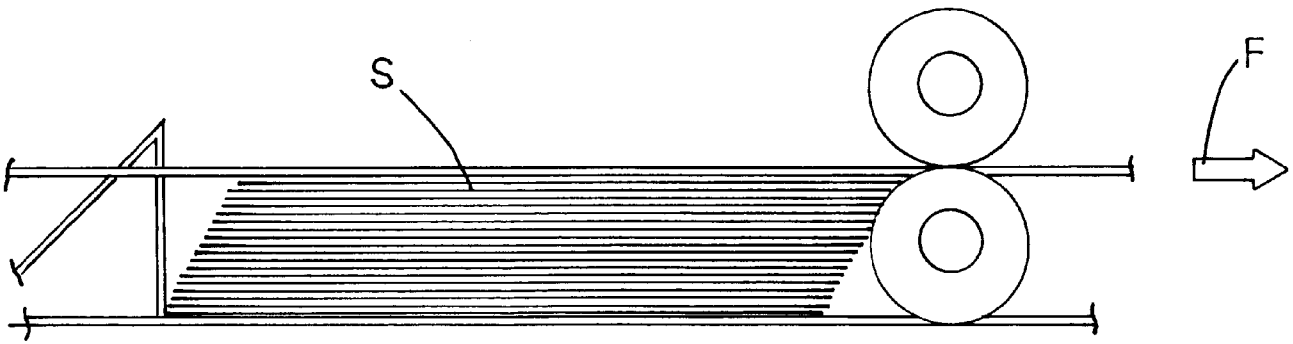
(PRIOR ART) FIG. 1
FIG. 1 of the drawings is an exaggerated side view depicting a deficiency with prior art accumulators.
Figure 2A:
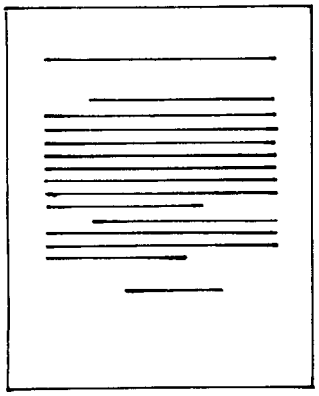
FIGS. 2A and 2B of the drawings are plan and side views respectively of a properly registered stack of sheet material.
Figure 2B:
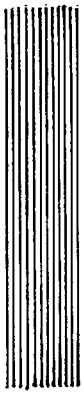
Figure 3A:
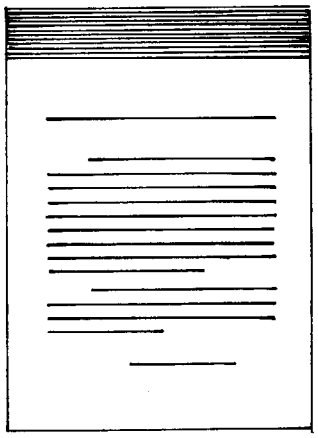
FIGS. 3A and 3B of the drawings are plan and side views respectively of a mis-registered stack of sheet material.
Figure 3B:
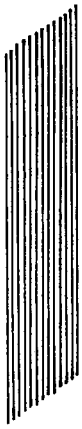
Figure 4:
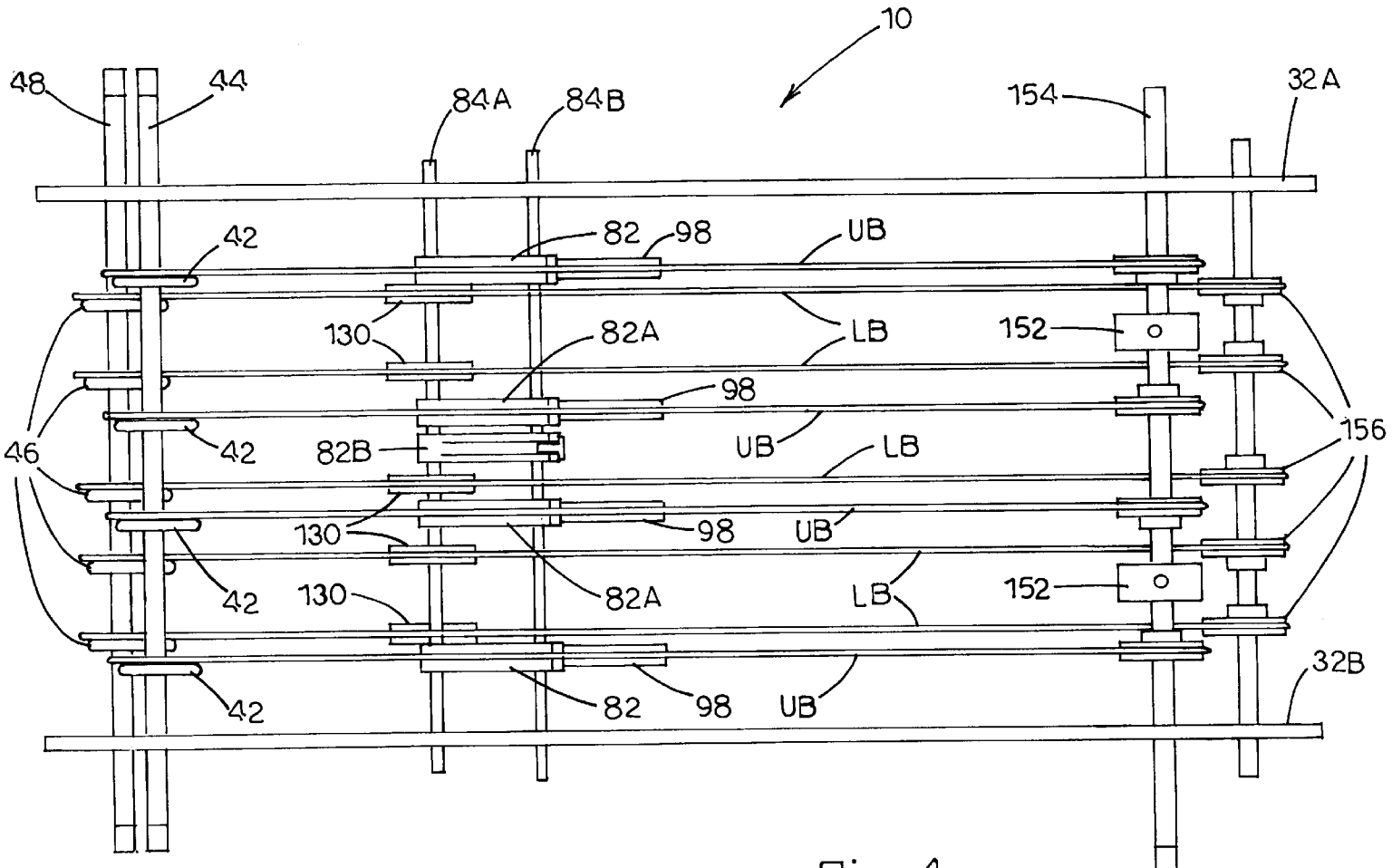
FIG. 4 of the drawings is a simplified schematic top view of an accumulator according to the invention.
Figure 5:
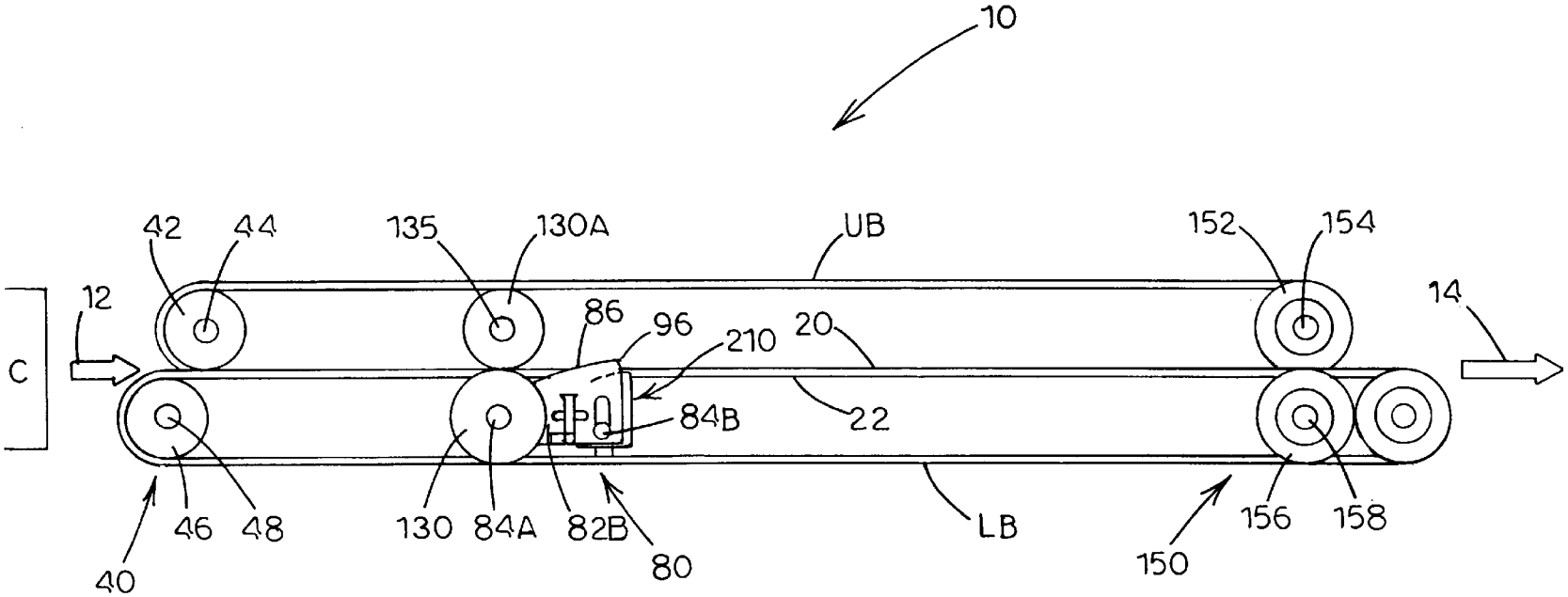
FIG. 5 of the drawings is a simplified schematic side view of an accumulator according to the invention.
Figure 6:
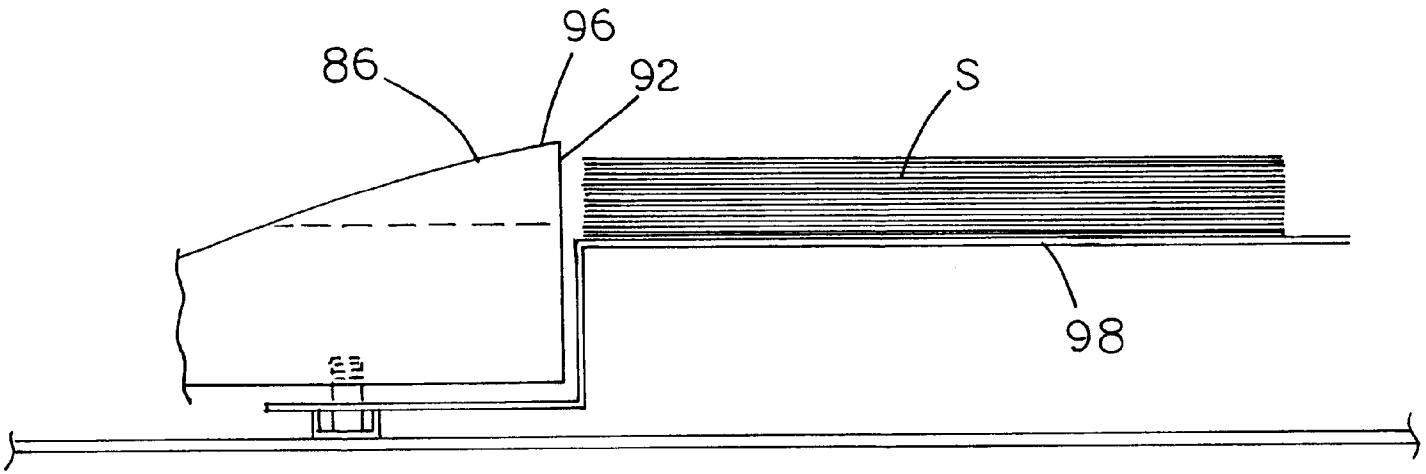
FIG. 6 of the drawings show a ramp structure with sheet support for use with the accumulator according to the invention.

In accordance with the present invention, an accumulator apparatus generally designated 10 is provided and shown schematically in FIGS. 4 and 5. The basic operation, structure, and control features of such accumulator apparatuses are well known to those skilled in the art.

Accumulator apparatus 10 comprises upper belt means and lower belt means adapted for advancement of sheet articles there between. The upper belt means comprises a plurality of spaced-apart belts illustrated in the preferred embodiment at least partially in FIGS. 4 and 5 as driven upper endless elastic polycord belts UB. Similarly, the lower belt means also comprises a plurality of spaced-apart belts illustrated in a preferred embodiment at least partially in FIGS. 4 and 5 as driven lower endless elastic polycord belts LB. Upper belts UB include lower reaches 20, and lower belts LB include upper reaches 22. Upper belts UB and lower belts LB are driven, usually continuously, such that lower reaches 20 and upper reaches 22 move at substantially the same speed in a common direction in which sheet articles can be processed through accumulator apparatus 10 as indicated by entry arrow 12 and exit arrow 14 of FIG. 5. Upper belts UB and lower belts LB are supported by guide rollers, as will be described below. Any suitable conventional drive system (not shown) can be utilized to drive upper belts UB and lower belts LB and their guide roller such as an operative interconnection of shafts and the utilization of a conventional clutch/brake system (not shown in the instant application but described in the prior art). Lower reaches 20 of upper belts UB and upper reaches 22 of lower belts LB are substantially disposed in and thereby define a generally horizontal feeding plane for sheet articles processed through accumulator apparatus 10.

Accumulator apparatus 10 is preferably modular in design so as to be easily interchangeable in line with other sheet article processing components. Accumulator apparatus 10 also comprises frame portions, as generally described in any of U.S. Pat. No. 5,755,689 or 5,244,200, commonly assigned herewith, and whose contents are incorporated by reference herein.

At the entry end 12 of accumulator apparatus 10 where sheet articles can advance into accumulator apparatus 10 between upper belts UB and lower belts LB, entry roller guide means generally designated 40 is provided and comprises a plurality of upper guide rollers 42 fixedly attached in a spaced-apart relationship to shaft 44. Entry roller guide means 40 additionally comprises a plurality of lower guide rollers 46 fixedly attached in a spaced-apart relationship to shaft 48. Shafts 44 and 48 are fixedly but rotatably attached to and between side plates 32A and 32B. Upper belt UB extends around upper guide rollers 42, and lower belt LB extends around lower guide rollers 46 as shown in FIGS. 4 and 5 of the drawings.

In accordance with this invention, upper guide rollers 42 and lower guide rollers 46 are vertically misaligned along the centerline such that a gap or space exists therebetween. In a preferred embodiment, a space of approximately ¼ of an inch exists between the lowest portions of upper guide rollers 42 and the highest portions of lower guide rollers 46. Also in the preferred embodiment, upper guide rollers 42 and lower guide rollers 46 are positioned on shafts 44 and 48, respectively, in an alternating manner where they intentionally are not vertically aligned such that upper guide rollers 42 and lower guide rollers 46 cannot pinch together sheet articles positioned therebetween. In this manner, upper guide rollers 42 and lower guide rollers 46, in operative association with upper belts UB and lower belts LB, respectively, provide a guide for sheet articles advancing therebetween without pinching or marking the sheet articles.

While it is envisioned that accumulator apparatus 10 can be operatively attached downstream of any suitable component for processing sheet articles, accumulator apparatus 10 has particularly advantageous application when directly attached downstream of a device such as a cutter apparatus C, as shown and described in more detail in U.S. Pat. No. 5,775,689, whose contents are incorporated by reference herein, without the use or need of a cutter interface. When so attached, sheet articles exiting cutter apparatus C can enter accumulator apparatus 10 and be guided thereinto by upper guide rollers 42 and lower guide rollers 46 without pinching of the entering sheet articles. As will be apparent to those of skill in the art, a cutter interface can still be necessary in certain circumstances such as, for example, with connection to Right Angle and Turnover Sequencer modules.

Downstream from entry roller guide means 40, accumulator apparatus 10 comprises ramp means generally designated 80 in FIG. 5 for deflecting sheet articles processed between upper belt means UB and lower belt means LB from the horizontal feeding plane. As will be apparent to those of skill in the art of sheet material processing, ramp means 80 can include a plurality of suitable ramp members, such as a pair of side ramp members 82, a pair of intermediate ramp members 82A, and a centrally located ramp member 82B, which holds the novel aspect of this invention. All ramp members can be fixedly positioned. Ramp members 82, 82A, and 82B can also be selectively retractable for selective diversion of processed sheet articles as will be recognized by those of skill in the art and additionally in accordance with the disclosure of U.S. Pat. No. 5,244,200 to Manzke.

As shown in FIGS. 4 and 5, ramp members 82, 82A, and 82B are operatively interconnected by one or more shafts such as front shaft 84A, to which ramp members 82, 82A, and 82B can be fixedly or pivotably attached as described hereinabove, as well as second shaft 84B. Referring particularly to FIGS. 4–8, ramp members 82, 82A, and 82B comprise deflecting surfaces generally designated 86 with slots 88 parallel to polycord path (see FIG. 6) defined therein for extension there through of lower reaches 20 of upper belt UB. Ramp members 82 and 82A are in alignment with the lower reaches 20 of upper belt UB and have the belts passing through their belt slot 88, whereas ramp member 82B does not have a belt passing through its belt slot 88. Deflecting surfaces 86 terminate on the upper ends thereof at upper edges 96. It is to be understood therefore that deflecting surfaces 86 and upper edges 96 of ramp members 82, 82A, and 82B extend in an interposed position across the horizontal feeding plane for sheet articles (see FIG. 5).

Sheet articles advancing through accumulator apparatus 10 between upper belts UB and lower belts LB and past entry nip roller means 40 will therefore contact and be deflected by ramp members 82, 82A, and 82B out of the horizontal feeding plane and over upper edges 96. Due to their elasticity, lower reaches 20 of upper belts UB can also be diverted upwardly by sheets deflecting up ramp members 82, 82A, and 82B as will be appreciated by those of skill in the art. Downstream of upper edges 96, a deflected sheet article is urged back toward the horizontal feeding plane by resilient action of lower reaches 20 of upper belts UB due to their tension and/or diversion. Accumulator apparatus 10 can include a plurality of rollers 130 attached to shaft 84*a* below upper reaches 22 of lower belts LB to assist in maintenance of tension of upper reaches 22 of lower belts LB for facilitating resilient action by upper reaches 22 against diverted sheet articles. Similarly, accumulator apparatus 10 can include a plurality of rollers 130*a* attached to shaft 135 above lower reaches 20 of upper belts UB to assist in maintenance of tension of lower reaches 20 of upper belts UB for facilitating resilient action by lower reaches 20 against diverted sheet articles. Progressive seriatim feeding of sheet articles in the horizontal feeding plane where the sheet articles are deflected by ramp members 82, 82A, and 82B causes over-accumulation of sheet articles in a stack or accumulation location past upper edges 96 of ramp members 82, 82A, and 82B.

To further support sheet articles accumulated in the accumulation location, accumulator apparatus 10 can further include support means which can comprise in one embodiment a plurality of spaced-apart supports 98 which can extend from side ramp members 82 and intermediate ramp members 82A at an elevation slightly higher than upper reaches 22 of lower belts LB. As illustrated schematically in FIG. 6, sheet articles advanced past upper edges 96 of ramp members 82, 82A, and 82B are accumulated in a stack S which is supported on supports 98.

The leading edges of sheet articles accumulated in stack S are positioned against and stopped by selectively operable stop means generally designated 150 and located downstream from ramp means 80 and supports 98. While it is envisioned according to this invention that stop means 150 could comprise any suitable means for selectively stopping and advancing accumulated sheet articles, stop means 150 comprises in the preferred embodiment the nip formed by a plurality of spaced-apart upper stop rollers 152 attached to shaft 154 and a plurality of spaced-apart lower stop rollers 156 attached to shaft 158. In the accumulated position, the leading edges of the sheet articles in stack S collect within this nip and the trailing edges of the sheet articles in stack S are preferably spaced apart a small predetermined distance from vertical edges 92 of ramp members 82 and 82A, although it is envisioned that they could be in contact with vertical edges 92. Stack S is therefore contained between vertical edges 92 and stop means 150. Conventionally, upon receipt of a "feed" signal, rollers 152 and 156 are rotated by a drive means (not shown) and the stack of sheets in the nip are fed downstream and the accumulator emptied.

Figure 7:
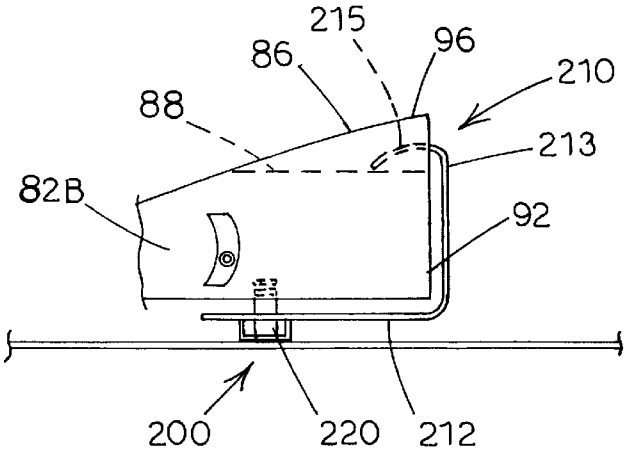
FIG. 7 of the drawings show a ramp structure with biasing element for use with the accumulator according to the invention.

Referring to FIG. 7, in accordance with a novel aspect of this invention, biasing element 200 is provided to reduce or eliminate sheet mis-registration or shingling back as described with respect to deficiencies of the prior art. Biasing element 200, typically foreseen to be in the form of leaf spring 210 made of stainless steel (or spring steel or equivalent) and is affixed to ramp member 82B, but other affixture options are possible. In a preferred embodiment, the steel member is approximately 0.010" thick and ½" wide by 3.5" long. The spring is bent as follows: 1.62" long horizontal lower surface 212 bent at 90 degrees upwardly to 1.5" high vertical portion 213, then bent back 90 degrees to 0.19" and then bent downwardly at 30 degrees for 0.19". This shape contours to the shape of the lower horizontal and downstream vertical edge 92 of ramp 82B. A typical method for affixing leaf spring 210 to ramp member 82 comprises the use of fastener 220, such as a screw, for clamping a lower surface 212 of leaf spring 210 to a lower portion of ramp member 82B. Substantially vertical portion 213 of leaf spring 210 is positioned after member 82B, in relation to the direction of sheet travel, leaving a ⅛" to 5/32" gap between the vertical edge 92 of the ramp 82B and the spring 210. "Substantially vertical", as used herein means that the portion of the leaf spring is positioned with respect to the horizontal in such a way that the rear edge of a top sheet in a stack is within a small tolerance of (if not directly over) the rear edge of the bottom sheet of a stack, rendering the stack leaning there against "squared". The upper surface 215 of spring 210 is bent toward ramp member 82B, resting in belt slot 88, to eliminate a surface on which the sheet might catch, and not settle properly as part of an accumulated set.

The function of biasing element 200 is to urge all the accumulating sheet articles from behind towards and into the nip formed by the upper 152 and lower 156 stop rollers. As the paper clears the ramp 82B, the spring 210 flexes back keeping pressure on the back edge of the accumulating sheet articles. Therefore, when the exit nip rollers act to empty the accumulator and feed the stack downstream, biasing element 200 urges the entire stack of accumulated articles towards the exit nip to insure that no sheets are left behind (i.e., "shingle back") in the accumulator. Additionally, since substantially vertical portion 213 will also act as a rear registration member, the stack of accumulated articles will be squarely fed downstream, resulting in cleaner folds, no jamming, and minimal sheet stoppage and paper damage.

While it might seem that biasing element 200 can be eliminated by merely moving ramp member 82 and 82A slightly further downstream towards stop means 150, this might not be a completely satisfactory solution. The rigidity of ramp member 82 and 82A, coupled with the smaller sheet accumulation area poses a higher sheet jamming risk. However, though the sheet accumulation area is smaller with biasing element 200, the fact that biasing element 200 is not rigid and will move with respect to the ramp (i.e. give with the force of the moving and settling paper) will not pose higher sheet jamming risk.

Figure 8:
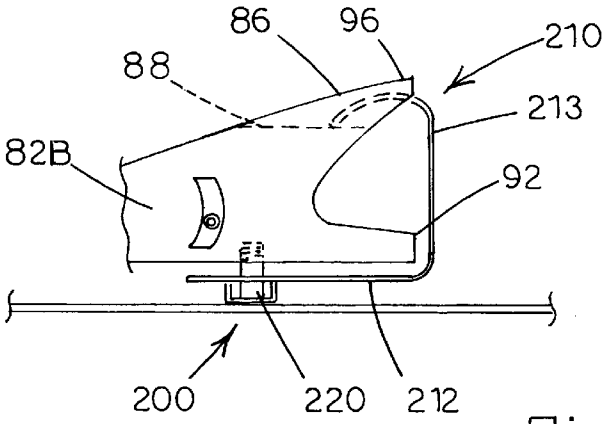
FIG. 8 of the drawings shows an alternative ramp structure for use with the accumulator according to the invention.

FIG. 8 of the drawings also shows an alternative ramp structure for use with the accumulator according to the invention. In this embodiment, because substantially vertical portion 213 of biasing element 200 is used to register the back of the sheets and not ramp members 82, 82A, and 82B, the rearmost portion of ramp members 82, 82A, and 82B can be cut-out, removed, or eliminated, thus reducing material costs.

While the invention has been shown and described in a preferred embodiment exemplified by an accumulator configured for over-accumulation, the invention can be equally applied to an accumulation configured for under-accumulation.

It can therefore be seen that the present invention provides a novel accumulator apparatus and method. It is also seen that the present invention provides an accumulator apparatus and method that reduces or eliminates sheet mis-registration and provides for clean folds, no jamming, and minimal machine stoppages and paper damage.

It will be understood that various details of the invention may be changed without departing from the scope of the invention. Furthermore, the foregoing description is for the purpose of illustration only, and not for the purpose of limitation, as the invention is defined by the following appended claims.

What is claimed is:

1. An accumulator apparatus for accumulating sheet articles, said accumulator apparatus comprising:

(a) upper belts and lower belts operative such that sheet articles can be advanced therebetween in an at least substantially horizontal feeding plane;

(b) at least one ramp operative for deflecting out of the feeding plane sheet articles advanced between the upper and lower belts;

(c) an accumulation location downstream of the at least one ramp, the accumulation location having an entrance and an exit; and (d) a biasing element, attached to the ramp for biasing accumulated sheet articles in rear registration towards the exit of the accumulation location.

2. The accumulator of claim 1, wherein:

(a) the exit end of the accumulation location comprises upper and lower exit nip rollers forming a nip; and (b) the biasing element urges the accumulating sheet articles into the nip.

3. The accumulator of claim 2, wherein the biasing element urges the accumulating sheet articles from behind the sheets.

4. The accumulator of claim 2, where the exit nip rollers are adapted for feeding accumulated sheet articles out of the accumulator.

5.The accumulator of claim 1, wherein the biasing element has a substantially vertical portion.

6. The accumulator of claim 1, wherein the at least one ramp has an inclined deflecting surface and the biasing element is positioned downstream from the inclined surface in relation to the direction of sheet travel.

7. The accumulator of claim 1, wherein the biasing element comprises a leaf spring.

8. The accumulator of claim 6, wherein the leaf spring is approximately 0.010" thick.

9. The accumulator of claim 6, wherein a rear portion of the ramp, adjacent the to a substantially vertical portion of the leaf spring, can be eliminated.

10. An accumulator apparatus for accumulating sheet articles, the accumulator apparatus comprising:

(a) upper belts and lower belts operative such that sheet articles can be advanced therebetween in an at least substantially horizontal feeding plane;

(b) at least one ramp operative for deflecting out of the feeding plane sheet articles advanced between the upper and lower belts;

(c) an accumulation location downstream of the at least one ramp, the accumulation location having an entrance and an exit; and (d) a leaf spring biasing accumulating sheet articles towards the exit of the accumulation location.

11. A method of accumulating sheets, comprising the steps of:

(a) advancing sheets deflected by a ramp into an accumulation location having an entrance and an exit; and (b) using a biasing element attached to the ramp to register the sheets in rear end registration after deflection by the ramp and during accumulation of the sheets in the accumulation location and to urge the accumulated sheets toward the exit of the accumulation location.

12. A method of accumulating sheets, comprising the steps of:

(a) feeding sheets into an accumulation area having an entrance and an exit;

(b) at least partially registering the sheets against the exit as they are fed into the accumulation area; and (c) biasing sheets in the accumulation area towards the exit by using a leaf spring to bias the sheets from the rear towards the exit.

* * * * *